US008365754B2

(12) United States Patent
Riley et al.

(10) Patent No.: US 8,365,754 B2
(45) Date of Patent: Feb. 5, 2013

(54) VALVE COVER ASSEMBLY AND METHOD OF USING THE SAME

(75) Inventors: Andrew Dale Riley, Eufaula, OK (US); Randall Ferrain Weaver, Haywood, OK (US)

(73) Assignee: National Oilwell Varco, L.P., Houston, TX (US)

( * ) Notice: Subject to any disclaimer, the term of this patent is extended or adjusted under 35 U.S.C. 154(b) by 650 days.

(21) Appl. No.: 12/549,052

(22) Filed: Aug. 27, 2009

(65) Prior Publication Data

US 2010/0054974 A1 Mar. 4, 2010

Related U.S. Application Data

(60) Provisional application No. 61/092,256, filed on Aug. 27, 2008.

(51) Int. Cl.
*F16K 43/00* (2006.01)

(52) U.S. Cl. ..... 137/15.17; 137/454.4; 417/454; 285/91; 285/391

(58) Field of Classification Search ..... 417/454, 417/559, 563; 137/15.17, 15.18, 15.19, 315.11, 137/315.33, 315.41, 327, 454.2, 454.4, 454.6; 403/319; 285/91, 391
See application file for complete search history.

(56) References Cited

U.S. PATENT DOCUMENTS

| | | | | |
|---|---|---|---|---|
| 2,510,337 | A * | 6/1950 | Franklin | 119/822 |
| 2,510,377 | A * | 6/1950 | Carr | 92/165 R |
| 3,189,372 | A * | 6/1965 | Johnson | 285/91 |
| 3,510,233 | A * | 5/1970 | Strebel et al. | 417/454 |
| 4,782,858 | A | 11/1988 | Fujiwara | |
| 2005/0008448 | A1 * | 1/2005 | Doubler et al. | 411/353 |
| 2005/0226754 | A1 * | 10/2005 | Orr et al. | 417/571 |
| 2005/0236047 | A1 * | 10/2005 | Thomas et al. | 137/359 |
| 2006/0029502 | A1 | 2/2006 | Kugelev et al. | |
| 2008/0093361 | A1 * | 4/2008 | Kennedy et al. | 220/233 |
| 2011/0283537 | A1 * | 11/2011 | Case et al. | 29/890.124 |

FOREIGN PATENT DOCUMENTS

| | | |
|---|---|---|
| JP | 2004519584 | 7/2004 |
| WO | 02081911 | 10/2002 |

OTHER PUBLICATIONS

Canadian Office Action Dated Jul. 25, 2012; Canadian Application No. 2,733,240 (4 p.).
International Search Report and Written Opinion dated Feb. 4, 2010 for Appl. No. PCT/US2009/055185; (8 p.).
P-Quip Ltd. ; Kwik-Cover; Mud Pump Valve Covers; (2 p.), Dec. 19, 2007.
P-Quip Ltd.; Instructions for the Safe Use of P-Quip Valve Cover Retention Systems—Pt. No. 12000000; (Rev. Date: 12/19/2007); (6 p.).
P-Quip Ltd.; Instructions for the Safe Use of P-Quip Valve Cover Retention Systems—Pt. No. 14000001; (Rev. Date: Jan. 27, 2009); (6 p.).
P-Quip Ltd.; Instructions for the Safe Use of P-Quip Valve Cover Retention Systems—Pt. No. 16000001; (Rev. Date: Dec. 19, 2007); (6 p.).

(Continued)

*Primary Examiner* — Craig Schneider
*Assistant Examiner* — Ian Paquette
(74) *Attorney, Agent, or Firm* — Conley Rose, P.C.

(57) ABSTRACT

A valve cover assembly for a pump. In an embodiment, the valve cover assembly comprises a first cylindrical member having a central axis and a first throughbore. In addition, the valve cover assembly comprises a second cylindrical member coaxially disposed within the first throughbore and rotatable relative to the first cylindrical member about the central axis between a first position and a second position. In the first position, the second cylindrical member is axially translatable relative to the first cylindrical member. In the second position, the second cylindrical member is axially fixed relative to the first cylindrical member.

24 Claims, 13 Drawing Sheets

OTHER PUBLICATIONS

P-Quip Ltd.; Instructions for the Safe Use of P-Quip Valve Cover Retention Systems—Pt. No. 16000002; (Rev. Date: Dec. 19, 2007); (6 p.).

P-Quip Ltd.; Instructions for the Safe Use of P-Quip Valve Cover Retention Systems—Pt. No. 17000002; (Rev. Date: Aug. 21, 2003); (5 p.).

P-Quip Ltd.; Instructions for the Safe Use of P-Quip Valve Cover Retention Systems—Pt. No. 17000005; (Rev. Date: Aug. 21, 2003); (5 p.).

P-Quip Ltd.; Instructions for the Safe Use of P-Quip Valve Cover Retention Systems—Pt. No. 18000000; (Rev. Date: Dec. 19, 2007); (6 p.).

P-Quip Ltd.; Instructions for the Safe Use of P-Quip Valve Cover Retention Systems—Pt. No. 20000008; (Rev. Date: Aug. 12, 2008); (6 p.).

P-Quip Ltd.; Instructions for the Safe Use of P-Quip Valve Cover Retention Systems—Pt. No. 2100000; (Rev. Date: Oct. 29, 2004); (5 p.).

P-Quip Ltd.; Instructions for the Safe Use of P-Quip Valve Cover Retention Systems—Pt. No. 22000003; (Rev. Date: Aug. 21, 2003); (6 p.).

P-Quip Ltd.; Instructions for the Safe Use of P-Quip Valve Cover Retention Systems—Pt. No. 22000004; (Rev. Date: Aug. 21, 2003); (6 p.).

P-Quip Ltd.; Instructions for the Safe Use of P-Quip Valve Cover Retention Systems—Pt. No. 22000005; (Rev. Date: Oct. 4, 2005); (6 p.).

P-Quip Ltd.; Instructions for the Safe Use of P-Quip Valve Cover Retention Systems—Pt. No. 23000001; (Rev. Date: Jul. 25, 2007); (5 p.).

* cited by examiner

VALVE COVER ASSEMBLY AND METHOD OF USING THE SAME

CROSS-REFERENCE TO RELATED APPLICATIONS

This application claims the benefit under 35 U.S.C. §119(e) of U.S. Provisional Patent Application Ser. No. 61/092,256 filed Aug. 27, 2008 and entitled "Valve Cover Assembly," which is hereby incorporated herein by reference in its entirety.

STATEMENT REGARDING FEDERALLY SPONSORED RESEARCH OR DEVELOPMENT

Not Applicable.

BACKGROUND

1. Field of Art

The present disclosure relates generally to suction and discharge valves for reciprocating pumps. More particularly, the present disclosure relates to apparatus and methods that enable access to suction and discharge valves of reciprocating pumps and closure of chambers which contain them.

2. Description of the Related Art

Reciprocating pumps are used in various operations to pressurize an often abrasive slurry mixture of solids and liquids. For example, reciprocating pumps are used in drilling operations to pressurize a slurry mixture of solids and liquids known as drilling mud, which is then conveyed to the bottom of a borehole drilled in the earth. The pressurized mud is used to maintain appropriate borehole pressure, lubricate and cool a downhole drill bit, and carry loosened sediment and rock cuttings from the borehole bottom to the surface. At the surface, the cuttings and sediment are removed from the returning drilling mud, and the filtered drilling mud may be recycled and pumped back to the borehole bottom.

Suction and discharge valves are used in reciprocating pumps to control the flow of fluid into and out of the pump's cylinders where the fluid is pressurized. Due to the highly abrasive nature of the particles often present in the fluid to be pressurized, the valves and seals of the pumps must be designed to resist harsh abrasion, while maintaining positive sealing action under relatively high operating pressures. Even so, the valves have a finite service life, and normally fail due to deterioration of the elastomeric sealing element of the valve, deterioration caused by erosion of the mating metal contact surfaces of the valve and valve seat, or combinations thereof. When leakage through the valves is sufficient to render the pump unable to maintain satisfactory fluid pressure for the drilling conditions, the valves must be replaced.

Maintenance of these valves is a time consuming and difficult process that presents risks of injuries to service personnel. To service most conventional valves, the valve cover is typically removed by first loosening the valve cover with a heavy sledge hammer, and then unscrewing the valve cover to disengage a relatively long length of threads between the cover and its seat. Further, maintenance of most conventional valves is usually costly since the pump must be shut down during such maintenance procedures, thereby interrupting the drilling activity.

Accordingly, there remains a need to develop apparatus and methods for safely and quickly accessing suction and discharge valves of reciprocating pumps.

SUMMARY OF THE DISCLOSED EMBODIMENTS

These and other needs in the art are addressed in one embodiment by a valve cover assembly for a pump. In an embodiment, the valve cover assembly comprises a first cylindrical member having a central axis and a first throughbore. In addition, the valve cover assembly comprises a second cylindrical member coaxially disposed within the first throughbore and rotatable relative to the first cylindrical member about the central axis between a first position and a second position. In the first position, the second cylindrical member is axially translatable relative to the first cylindrical member. In the second position, the second cylindrical member is axially fixed relative to the first cylindrical member.

These and other needs in the art are addressed in another embodiment by a pump assembly. In an embodiment, the pump assembly comprises a valve module. The valve module includes a valve module body having an inner chamber, a valve access bore extending from an outer surface of the valve module body to the inner chamber, and a valve at least partially disposed within the inner chamber and accessible through the valve access bore. In addition, the pump assembly comprises a valve cover assembly coupled to the valve module body over the valve access opening. The valve cover assembly includes a first cylindrical member having a central axis and an axially extending throughbore. Further, the valve cover assembly includes a second cylindrical member coaxially disposed within the throughbore and rotatable relative to the first cylindrical member about the central axis between a first position and a second position relative to the first cylindrical member. In the first position, the second cylindrical member is axially translatable relative to the first cylindrical member. In the second position, the second cylindrical member is axially fixed relative to the first cylindrical member. Moreover, the valve cover assembly includes a third cylindrical member rotatably coupled to the second cylindrical member and adapted to rotate the second cylindrical member about the central axis between the first and the second positions.

These and other needs in the art are addressed in another embodiment by a method for coupling a valve cover to a pump assembly. In an embodiment, the method comprises securing a first cylindrical member to the pump assembly, wherein the first cylindrical member has a central axis and an axially extending throughbore. In addition, the method comprises circumferentially aligning a set of interlocking lugs on a radially outer surface of a second cylindrical member between two adjacent sets of interlocking lugs on a radially inner surface of the first cylindrical member. Further, the method comprises axially inserting the second cylindrical member into the throughbore of the first cylindrical member. Still further, the method comprises rotating the second cylindrical member about the central axis relative to the first cylindrical member to engage the set of interlocking lugs on the second cylindrical member with one of the sets of interlocking lugs on the first cylindrical member.

Thus, embodiments described herein comprise a combination of features and advantages intended to address various shortcomings associated with certain prior devices, systems, and methods. The various characteristics described above, as well as other features, will be readily apparent to those skilled in the art upon reading the following detailed description, and by referring to the accompanying drawings.

BRIEF DESCRIPTION OF THE DRAWINGS

For a more detailed description of the disclosed embodiments, reference will now be made to the accompanying drawings, wherein.

DETAILED DESCRIPTION OF THE DISCLOSED EMBODIMENTS

Figure 1:
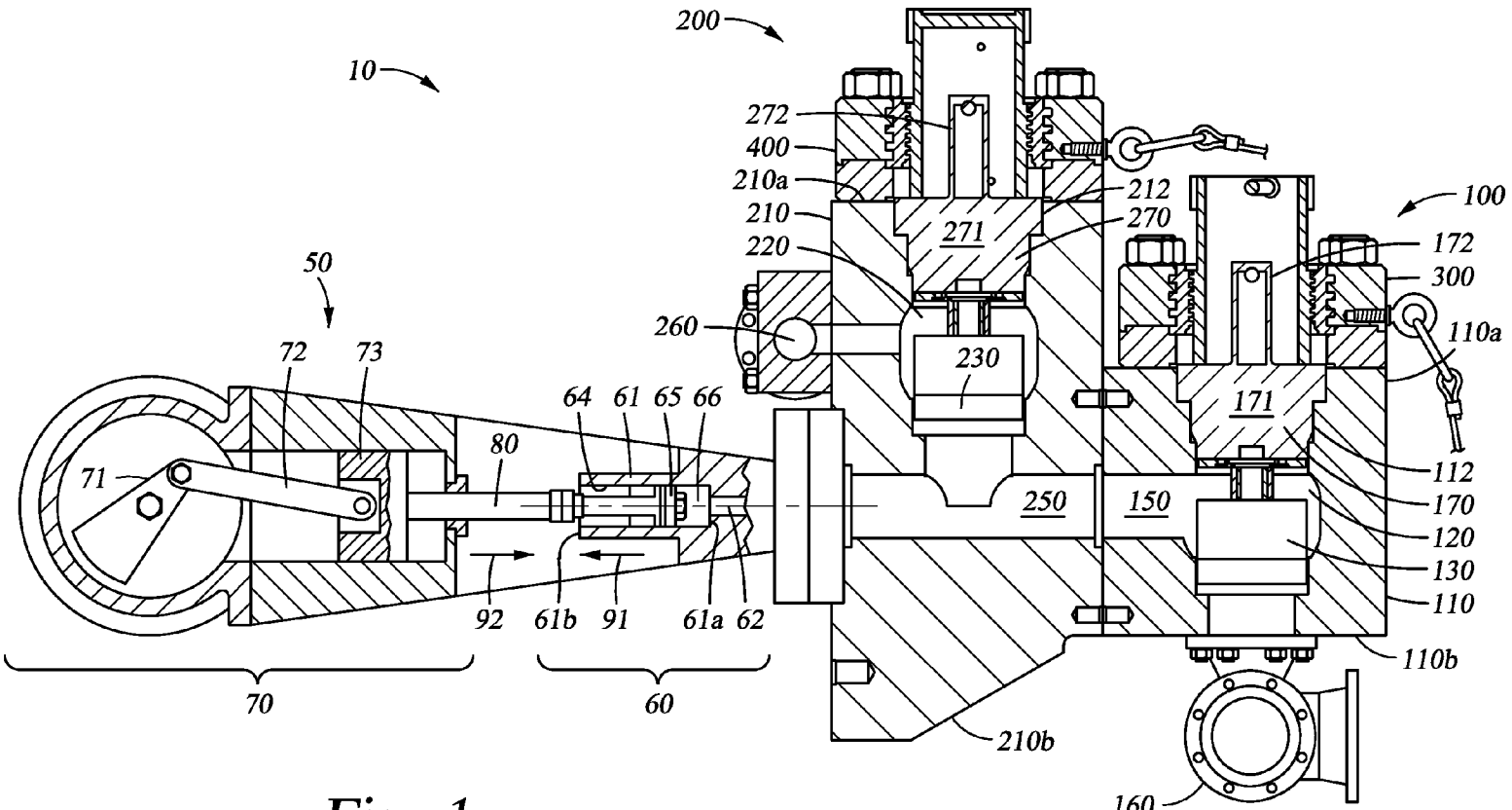
FIG. 1 is a partial, cross-sectional view of a reciprocating pump in accordance with the principles disclosed herein.

The following discussion is directed to various embodiments of the invention. Although one or more of these embodiments may be presently preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a bore), while the terms "radial" and "radially" generally mean perpendicular to the central axis. For instance, an axial distance refers to a distance measured along or parallel to the central axis, and a radial distance means a distance measured perpendicular to the central axis.

Referring now to FIG. 1, an embodiment of a reciprocating pump 10 for pumping a fluid (e.g., drilling mud) is shown. Reciprocating pump 10 includes a piston-cylinder assembly 50, a fluid suction or inlet module 100 coupled to the piston-cylinder assembly 50, and a fluid discharge or outlet module 200 coupled to the piston-cylinder assembly 50. In this embodiment, the discharge module 200 is positioned between the piston-cylinder assembly 50 and the suction module 100.

Piston-cylinder assembly 50 includes a fluid section 60 proximal outlet module 200 and a power section 70 distal outlet module 200. Fluid section 60 includes a cylinder 61 and a piston 65. Cylinder 61 has a central axis 62 and includes a first end 61*a*, a second end 61*b*, and a through bore 64 extending between ends 61*a, b*. Piston 65 is coaxially disposed within bore 64 and slidingly engages the inner surface of cylinder 61. Piston 65 and cylinder 61 define a chamber 66 within bore 64 between piston 65 and first end 61*a*. Power section 70 includes a crankshaft 71, connecting rod 72 and crosshead 73. An extension rod 80 couples crosshead 73 to piston 65. During operation, a motor (not shown) powers the rotation of crankshaft 71. The rotational motion of crankshaft 71 is translated into the reciprocating axial displacement of piston 65 relative to cylinder 61. As piston 65 moves axially within bore 64 in a first direction 338, the volume within chamber 66 increases; however, as piston 65 moves axially within bore 64 in a second direction 339 (opposite first direction 338), the volume within chamber 66 decreases.

Referring still to FIG. 1, suction module 100 comprises a body 110, an inlet chamber 120 within body 110, a flow passage or conduit 150 in fluid communication with inlet chamber 120, and a suction valve 130. As will be described in more detail below, valve 130 regulates the flow of fluid between a fluid supply 160 coupled to suction module 100 and chamber 120. Body 110 has an upper end 110*a*, a lower end 110*b*, and a valve access bore 112 extending from upper end 110*a* to inlet chamber 120. A plug 170 having a generally cylindrical body 171 is disposed in bore 112 and restricts and/or prevents fluid flow through bore 112. In this embodiment, plug 170 also includes a handle 172 extending upward from body 171 and generally away from upper end 110*a* of suction module body 110.

Discharge module 200 comprises a body 210, an outlet chamber 220 within body 210, a flow passage or conduit 250, and a discharge valve 230 disposed between chamber 220 and conduit 250. A fluid outlet 260 is in fluid communication with chamber 220. As will be described in more detail below, valve 230 regulates the flow of fluid between chamber 220 and conduit 250. Body 210 has an upper end 210*a*, a lower end 210*b*, and a valve access bore 212 extending from upper end 210*a* to inlet chamber 220. A plug 270 having a generally cylindrical body 271 is disposed in bore 212 and restricts and/or prevents fluid flow through bore 212. In this embodiment, plug 270 also includes a handle 272 extending upward from body 271 and generally away from upper end 210*a* of suction module body 210.

Referring still to FIG. 1, each module 100, 200 further comprises a valve cover assembly 300, 400, respectively, coupled to upper end 110*a*, 210*b*, respectively, of body 110, 210, respectively. Valve cover assembly 300 is seated on upper end 110*a* of suction module body 110 over valve plug 170, thereby holding and maintaining the proper seating of plug body 171 in bore 112. Likewise, valve cover assembly 400 is seated on upper end 210*a* of discharge module body 210 over valve plug 318, thereby holding and maintaining the proper seating of plug body 171 in bore 112. As will be described in more detail below, valve cover assemblies 300, 400 and plugs 318, 271 are removable to permit access to valves 130, 320, respectively, via access bores 112, 212, respectively, for installation, repair, service, and/or replacement operations.

Flow passages 150, 250 are in fluid communication with each other, and in fluid communication with chamber 66 of piston-cylinder assembly 50. Thus, valves 130, 230 may be described as being hydraulically coupled to fluid section 60 of piston-cylinder assembly 50 via conduits 150, 250. Each valve 130, 230 is configured to allow flow therethrough in only one direction. In particular, valves 130, 230 are configured and arranged such that suction valve 130 allows fluid to flow from fluid supply 160 into conduits 150, 250, and discharge valve 230 allows fluid to flow from conduits 150, 250 into outlet chamber 220 and fluid outlet 260. Suction valve 130 restricts and/or prevents fluid flow from conduits 150, 250 into fluid supply 160, and discharge valve 230 restricts and/or prevents fluid flow from fluid outlet 260 and chamber 220 into conduits 150, 250.

During operation of pump 10, a motor (not shown) drives the rotation of crankshaft 71, which results in the reciprocating axial translation of piston 65 relative to cylinder 61. As piston 65 reciprocates within bore 64, the volume of chamber 66 cyclically expands and contracts. Since chamber 66 is in fluid communication with conduits 150, 250, the expansion and contraction of the volume within chamber 66 results in a decrease and increase, respectively, in the fluid pressure within conduits 150, 250. Thus, when piston 65 moves in second direction 339, the volume in chamber 66 decreases and fluid pressure in conduits 150, 250 increases. In response to the increased fluid pressure, suction valve 130 closes, and discharge valve 230 opens. When discharge valve 230 opens, the pressurized fluid in conduits 150, 250 flows through fluid outlet 260. When piston 65 reverses direction and moves in first direction 338, the volume in chamber 66 increases and fluid pressure in conduits 150, 250 decreases. In response to the reduced fluid pressure, discharge valve 230 closes, and suction valve 130 opens. When suction valve 130 opens, fluid flows from fluid supply 160 into conduits 150, 250. The cycle then repeats, often at a high cyclic rate, as fluid is pressurized by pump 10. When it is necessary or desirable to perform maintenance on either valve 130, 230, the appropriate valve cover assembly 300, 400, respectively, and plug 170, 270, respectively, must be removed to permit access to valve 130, 230, respectively. Following the installation, service, and/or repair operation on valve 130, 230, plug 170, 270, respectively, and valve cover assembly 300, 400, respectively, is reinstalled on module 100, 200, respectively.

In the embodiment shown in FIG. 1, each valve cover assembly 300, 400 is substantially identical, both in structure and function. Hence, for the sake of brevity, only one valve cover assembly 300, 400 will be described in detail. However, the detailed description applies equally to both valve cover assemblies 300, 400.

Figure 2:
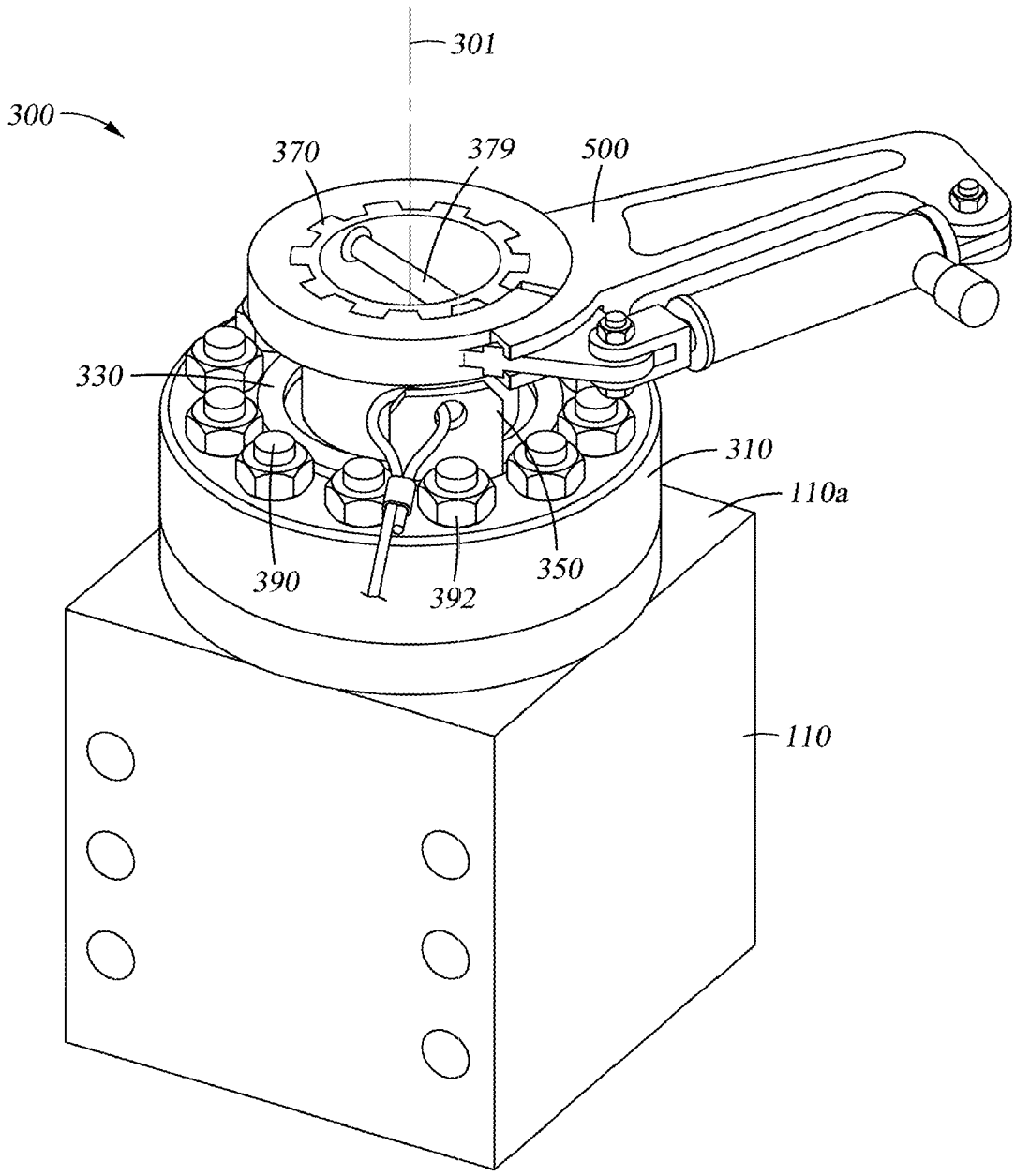
FIG. 2 is an assembled perspective view of the valve cover assembly and the suction module of FIG. 1.
Figure 3:
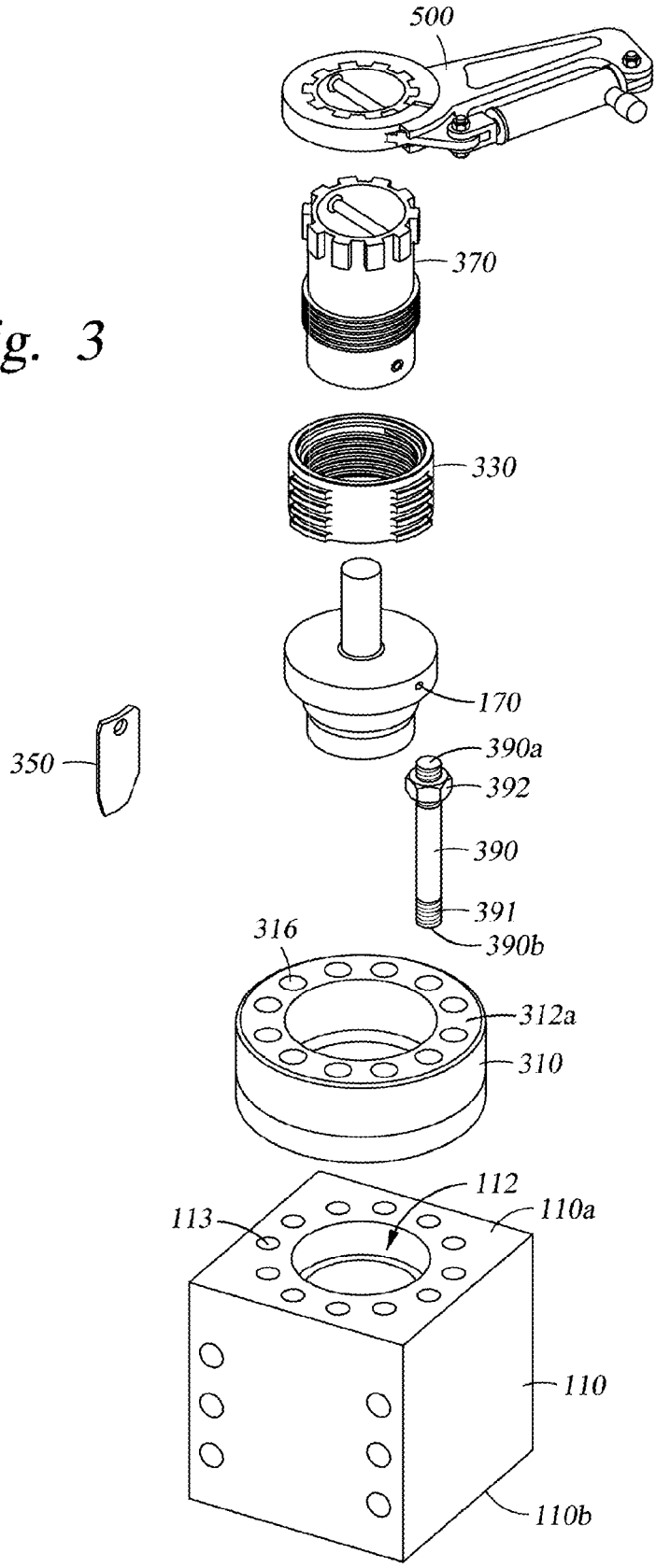
FIG. 3 is an exploded perspective view of the valve cover assembly and the suction module of FIG. 1.

Referring now to FIGS. 2 and 3, valve cover assembly 300 has a central axis 301, and includes a lug ring 310, a lug adapter 330, a stop locator 350, a locking member 370, and a plurality of studs 390. In this embodiment, lug ring 310, lug adapter 330, and locking member 370 are each coaxially aligned. Consequently, lug ring 310, lug adapter 330, and locking member 370 each have a central axis coincident with central axis 301.

Figure 4:
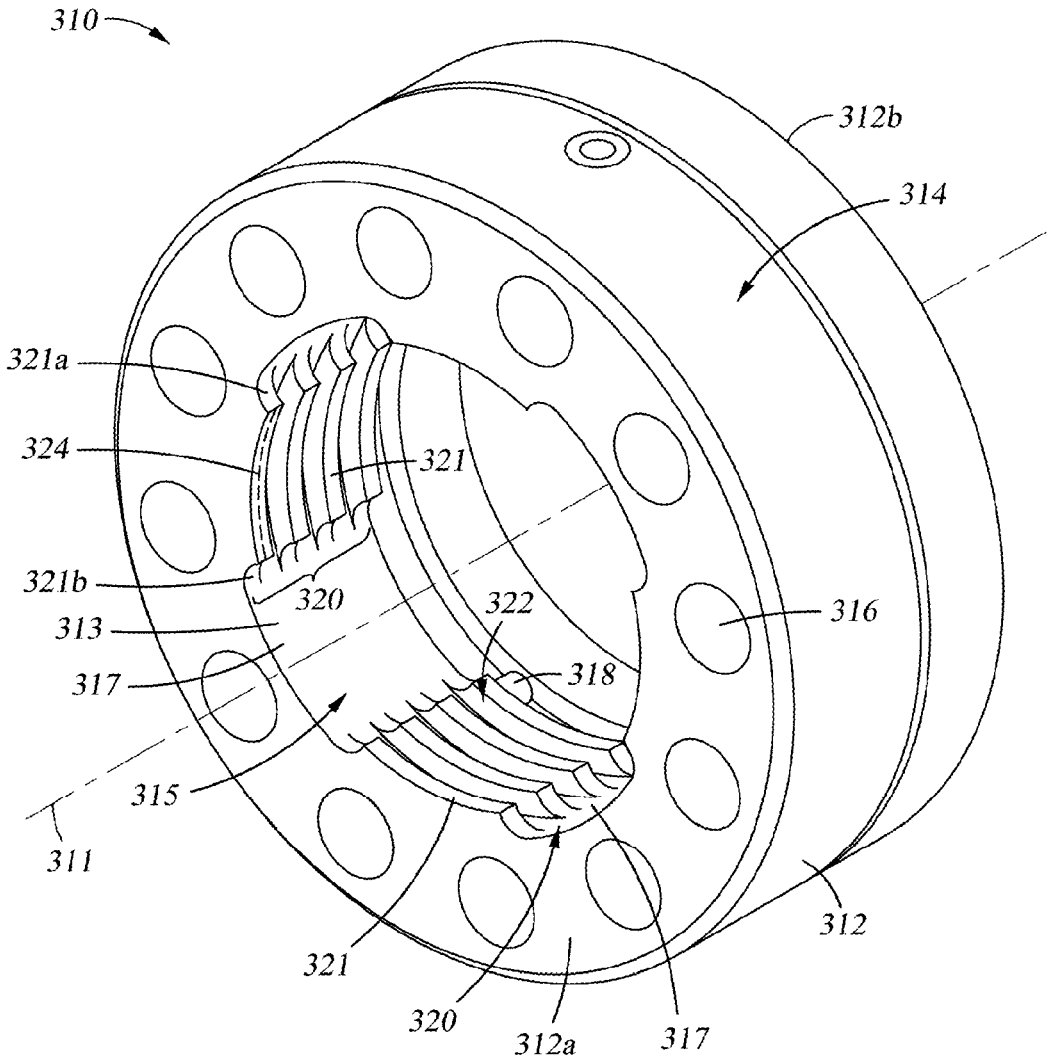
FIG. 4 is a perspective view of the lug ring of FIGS. 2 and 3.
Figure 5:
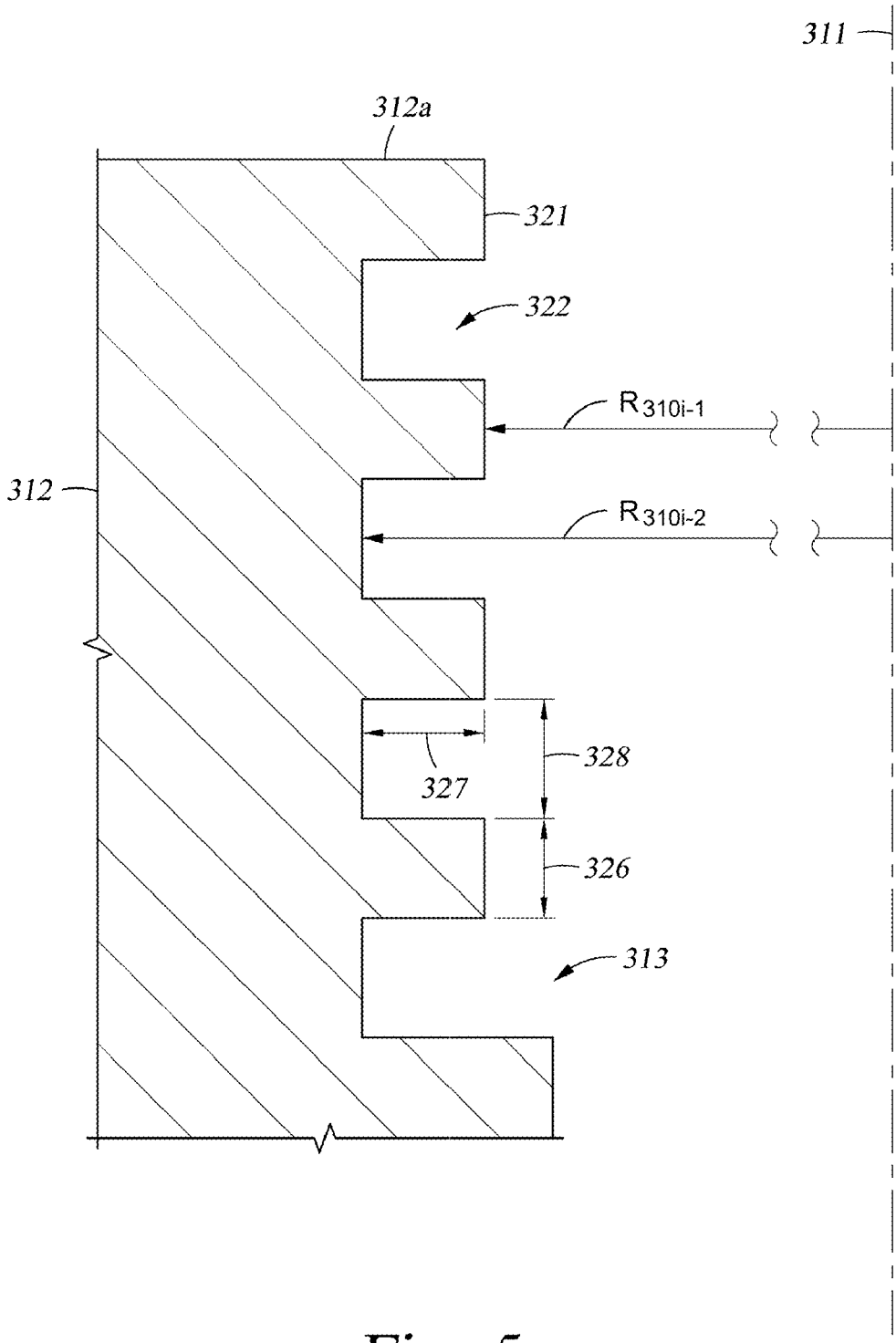
FIG. 5 is a partial cross-sectional view of the lug ring of FIGS. 2 and 3.

Referring now to FIGS. 4 and 5, lug ring 310 has a central axis 311 and comprises a generally cylindrical body 312 with a first or upper end 312*a*, a second or lower end 312*b*, a radially inner surface 313, and a radially outer surface 314. Radially inner surface 313 defines a central through bore 315 that extends coaxially through lug ring 310 between ends 312*a, b*. In addition, lug ring 310 includes a plurality of circumferentially spaced through bores 316. Each bore 316 extending axially through body 312 between ends 312*a, b* and is radially positioned between surfaces 313, 314. In this embodiment, bores 316 are each radially positioned substantially equidistant from central axis 311.

As best shown in FIGS. 2 and 3, bores 316 are configured to slidingly receive studs 390, which couple lug ring 310 to suction module 100. Specifically, each elongate stud 390 has opposite ends 390*a, b* comprising threads 391. Further, upper end 110*a* of suction module body 110 includes internally threaded counterbores 113 generally arranged in a circle about bore 112. One stud 390 is disposed in each bore 316 with one end 390*b* threadingly engaging one counterbore 113 and the other end 390*a* threadingly engaging a nut 392. Each nut 392 is threadingly advanced onto end 390*a* until lug ring 310 is sufficiently seated on upper end 110*a* of suction module body 110, thereby securely coupling lug ring 310 to suction module body 110.

Referring again to FIGS. 4 and 5, inner surface 313 of lug ring 310 comprises one or more circumferentially spaced sets or groups 320 of elongate interlocking lugs 321 that extend radially inward. In this embodiment, four uniformly angularly and circumferentially spaced groups 320 are provided. In particular, groups 320 are uniformly angularly spaced about 45° apart. In addition, in this embodiment, four axially spaced lugs 321 are provided within each group 320.

Lugs 321 of each group 320 are axially spaced one above the other along inner surface 313 between ends 312*a, b*. Further, within each group 320, the plurality of elongate lugs 321 are generally parallel to each other. The vertical alignment and spacing of lugs 321 results in the formation of a recess or slot 322 between each pair of axially adjacent lugs 321.

As best shown in FIG. 5, lug ring 310, body 312, and bore 315 may be described has having a first inner radius $R_{310i-1}$ measured radially from central axis 311 to the radially inner cylindrical surface of each lug 321, and a second inner radius $R_{310i-2}$ measured radially from central axis 311 to the cylindrical surface within each slot 322. Since lugs 321 extend radially inward into bore 315 relative to slots 322, first inner radius $R_{310i-1}$ is less than second inner radius $R_{310i-2}$.

Figure 8:
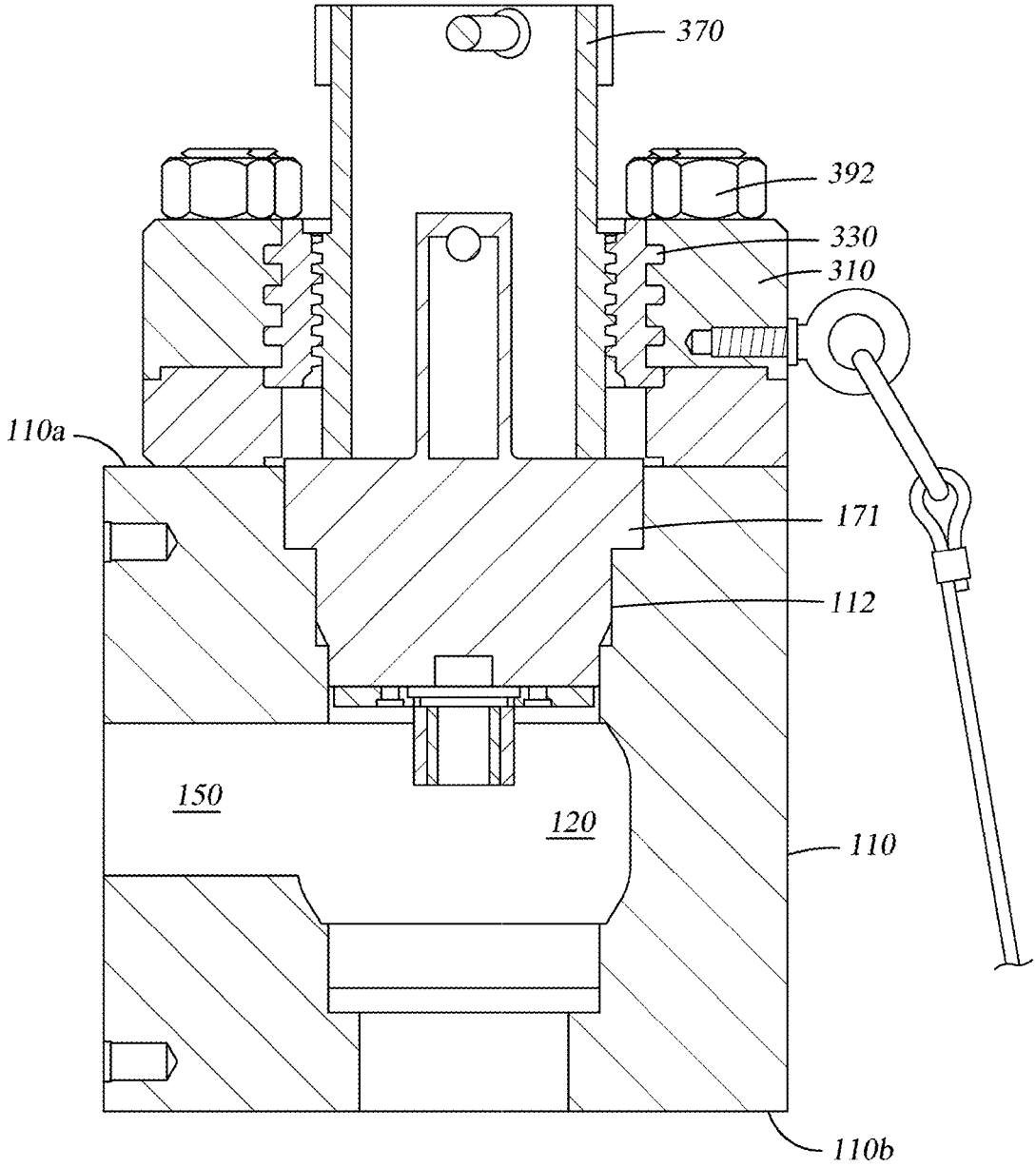
FIG. 8 is a cross-sectional view of the valve cover assembly of FIGS. 1 and 2.
Figure 9:
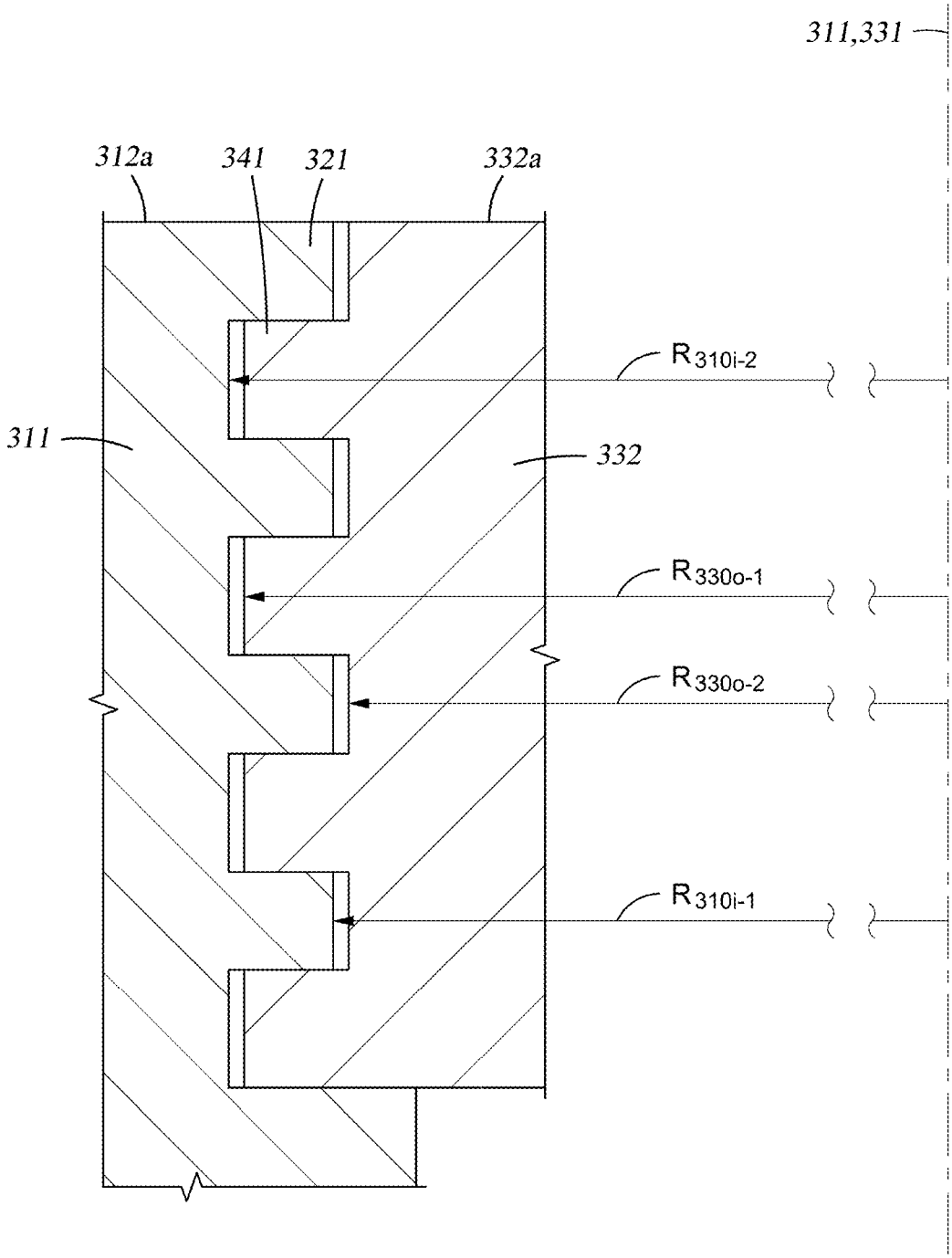
FIG. 9 is a partial cross-sectional view of the valve cover assembly of FIGS. 1 and 2.

Referring again to FIGS. 4 and 5, each lug 321 extends circumferentially along a longitudinal axis 324 between a first end 321*a* and a second end 321*b*. In particular, each lug 321 is positioned such that its longitudinal axis 324 is disposed in a plane perpendicular to central axis 311. Further, each lug 321 has a circumferential length measured along its axis 324 between its ends 321*a, b*. In this embodiment, the circumferential length of each lug 321 is about one-eighth the circumference of inner surface 313, and thus, ends 321*a, b* of each lug 321 are angularly spaced about 45° apart. In general, the circumferential length of each lug (e.g., lug 321) is less than the circumference of the inner surface of the lug ring (e.g., inner surface 313 of lug ring 310), but it may be shorter or longer than one-eighth of the circumference of the inner surface (e.g., inner surface 313). The remaining dimensions of each lug 321, e.g., its axial height 326 and radial width 327, are preferably selected such that each lug 321 engages a mating slot or recess disposed on lug adapter 330, as shown in FIGS. 8 and 9 and described in more detail below. Further, the dimensions of each slot 322, e.g., its axial height 328, are preferably selected such that each slot 322 is sized and configured to receive a lug disposed on lug adapter 330 as will be described in more detail below.

Referring specifically to FIG. 4, between each circumferentially spaced group 320 of lugs 321, inner surface 313 is substantially smooth, having no extensions or recesses (e.g., no lugs or slots are provided on inner surface 313 circumferentially between groups 320). In this embodiment, each segment of smooth cylindrical surface 317 is contiguous with and disposed at substantially the same radius $R_{310i-2}$ as the cylindrical surface of each slot 322. Thus, the portion of inner surface 313 disposed circumferentially between groups 320 comprises a substantially smooth cylindrical surface 317. The arc length of each portion of smooth surface 317 is selected to receive a group of lugs disposed on lug adapter 330. In this embodiment, groups 320 are circumferentially spaced about 45° apart, and thus, each portion of smooth surface 317 extends angularly 45° about central axis 311 and extends circumferentially about one-eighth the circumference of inner surface 313.

Although this embodiment includes four groups 320 of four lugs 321, in general, any suitable number of groups (e.g., groups 320) and lugs (e.g., lugs 321) may be employed. Further, although each lug 321 in this embodiment has a length that extends approximately ⅛ of the circumference of inner surface 313, or subtends an angle approximately equal to 45 degrees, and each portion of smooth surface 317 has an arc length that is substantially equal to that of each lug 321, in other embodiments, the arc length of each lug (e.g., lug 321) and of each portion of smooth surface (e.g., smooth surface 317) may subtend a different angle, such as 60 degrees.

Referring still to FIGS. 4 and 5, lug ring 310 further includes a plurality of pins 318, each pin 318 being positioned in one slot 322 and extending radially into bore 315. In this embodiment, one pin 318 is axially positioned in the lower-most slot 322 of each group 320 between the lower-most lug 321 and lower end 312*b*. As will be described in more detail below, pins 318 function to limit the rotation of lug adapter 330 relative to lug ring 310 during assembly of valve cover assembly 300.

Figure 6:
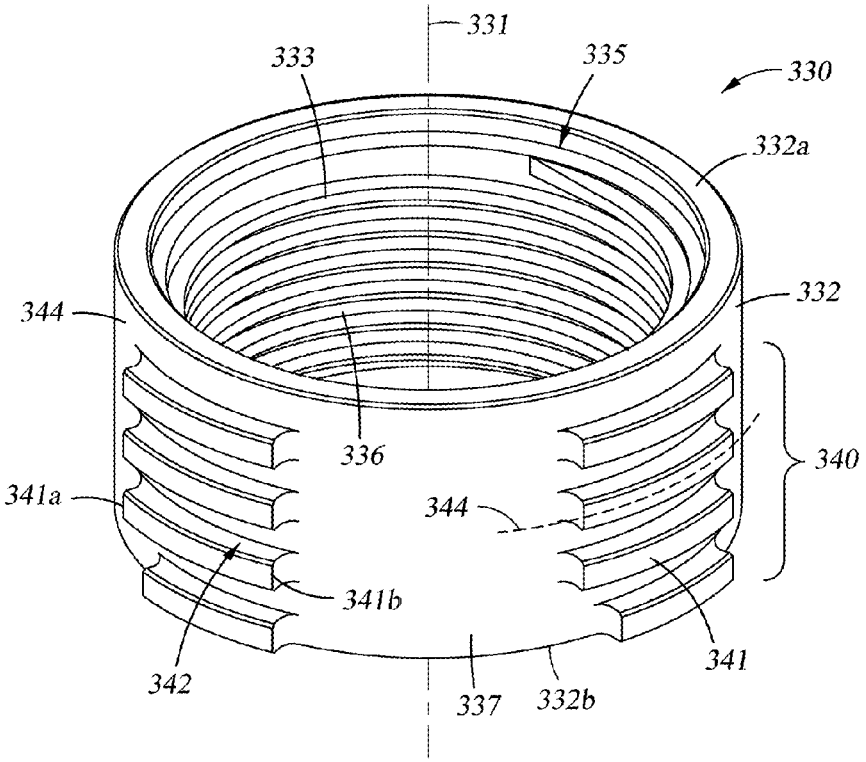
FIG. 6 is a perspective view of the lug adapter of FIGS. 2 and 3.
Figure 7:
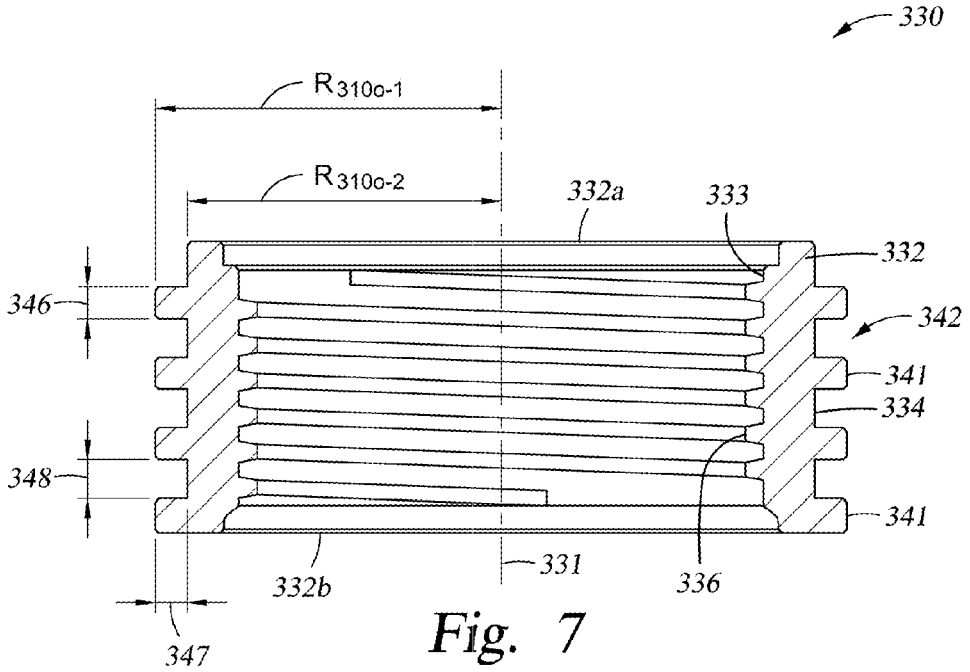
FIG. 7 is a cross-sectional view of the lug adapter of FIGS. 2 and 3.

Referring now to FIGS. 6 and 7, lug adapter 330 has a central axis 331 and comprises a generally cylindrical body 332 with a first or upper end 332*a*, a second or lower end 332*b*, a radially inner surface 333, and a radially outer surface 334. Radially inner surface 333 defines a central through bore 335 that extends axially through lug adapter 330 between ends 332*a, b*. Inner surface 333 of lug adapter 330 includes internal threads 336 configured to engage mating threads on locking member 370, as will be described in more detail below.

Outer surface 334 of lug adapter 330 includes one or more circumferentially spaced sets or groups 340 of elongate interlocking lugs 341 that extend radially outward. In this embodiment, four uniformly angularly and circumferentially spaced groups 340 are provided. Specifically, groups 340 are angularly spaced about 45° apart. In addition, in this embodiment, four axially spaced lugs 341 are provided within each group 340. Although this embodiment includes four groups 340 of four lugs 341, in general, any suitable number of groups (e.g., groups 340) and lugs (e.g., lugs 341) may be employed.

Lugs 341 of each group 340 are axially spaced one above the other, and distributed along outer surface 334 between ends 332*a, b*. Further, within each group 340, the plurality of elongate lugs 341 are generally parallel to each other. The vertical alignment and spacing of lugs 341 results in the formation of a recess or slot 342 between each pair of axially adjacent lugs 341.

As best shown in FIG. 7, lug adapter 330 may be described has having a first outer radius $R_{330o-1}$ measured radially from central axis 331 to the radially outer cylindrical surface of each lug 341, and a second outer radius $R_{330o-2}$ measured radially from central axis 331 to the cylindrical surface within each slot 342. Since lugs 341 extend radially outward relative to slots 342, first outer radius $R_{330o-1}$ is greater than second outer radius $R_{330o-2}$. As will be described in more detail below, upon assembly of valve cover assembly 300, lugs 321 of lug ring 310 engage mating slots 342 of lug adapter 330, and lugs 341 of lug adapter 330 engage mating slots 322 of lug ring 310. As best shown in FIG. 9, for proper intermeshing and engagement of lugs 321 and slots 342, and proper engagement of lugs 341 and slots 322, first outer radius $R_{330o-1}$ is preferably greater than first inner radius $R_{310i-1}$ and slightly less than second inner radius $R_{310i-2}$, and first inner radius $R_{310i-1}$ is preferably slightly greater than second outer radius $R_{330o-2}$ and less than first outer radius $R_{330o-1}$.

Referring again to FIGS. 6 and 7, each lug 341 extends circumferentially along a longitudinal axis 344 between a first end 341*a* and a second end 341*b*. In particular, each lug 341 is positioned such that its longitudinal axis 344 is disposed in a plane perpendicular to central axis 331. Further, each lug 341 has a circumferential length measured along its axis 344 between its ends 341*a, b*. The circumferential length of each group 340 (and hence the circumferential length of each lug 341 within the group 340) is less than the circumferential length of each segment of smooth surface 317 (FIG. 4) of lug ring 310. As a result, lug ring 310 and lug adapter 330 may be coaxially aligned, each group 340 of lugs 341 may be circumferentially aligned with one segment of smooth surface 317, and lug adapter 330 may be axially advanced into bore 315 of lug ring 310 without interference between lugs 321, 341. The remaining dimensions of each lug 341, e.g., its axial height 346 and radial width 347, are preferably selected such that each lug 341 engages one of mating slots 322 of lug ring 310, as shown in FIGS. 8 and 9. Further, the dimensions of each slot 342, e.g., its axial height 348, are preferably selected such that each slot 342 is sized and configured to receive one lug 321 of lug ring 310.

Referring specifically to FIG. 6, between each circumferentially spaced group 340 of lugs 341, outer surface 334 is substantially smooth, having no extensions or recesses e.g., no lugs or slots are provided on outer surface 334 circumferentially between groups 340). Thus, the portion of outer surface 334 disposed circumferentially between groups 340 comprises a substantially smooth cylindrical surface 337. In this embodiment, each segment of smooth cylindrical surface 337 is contiguous with and disposed at substantially the same radius $R_{330o-2}$ as the cylindrical surface of each slot 342. The circumferential length of each segment of smooth surface 337 is greater than the circumferential length of each group 320 (and hence greater than the circumferential length of each lug 321 in each group 320). As a result, lug ring 310 and lug adapter 330 may be coaxially aligned, each group 320 of lugs 321 may be circumferentially aligned with one segment of smooth surface 337, and lug adapter 330 may be axially advanced into bore 315 of lug ring 310 without interference between lugs 321, 341.

Figure 10:
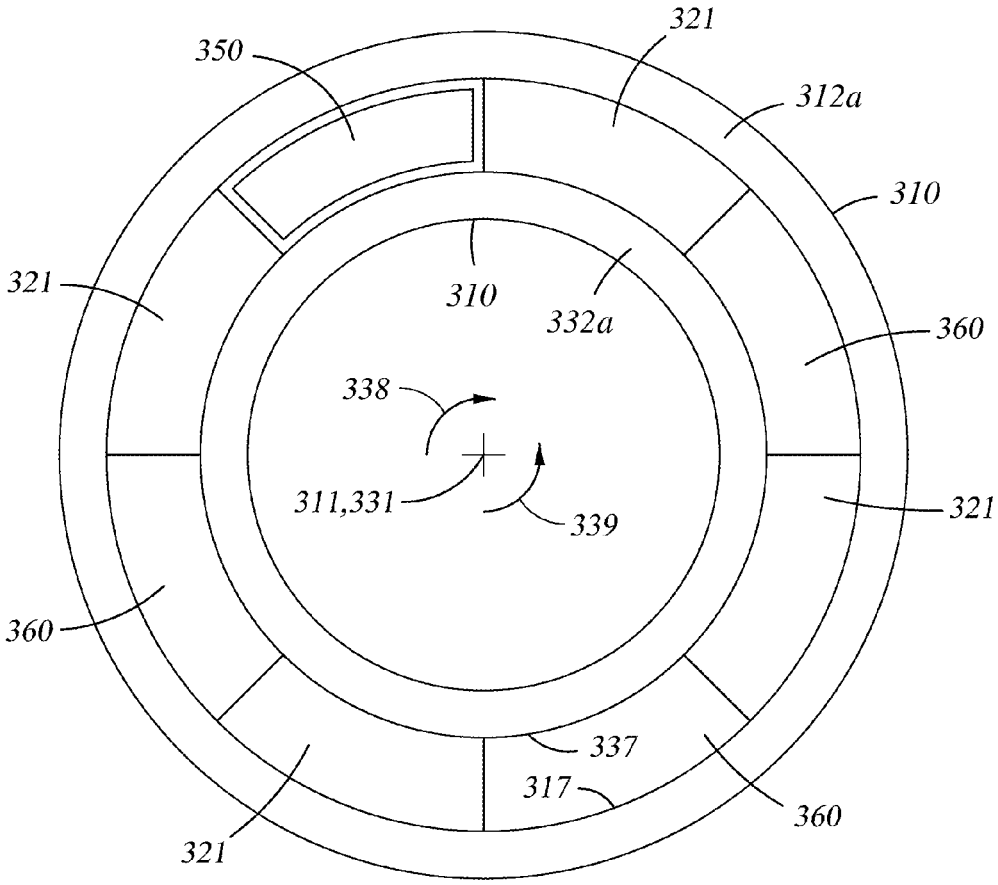
FIG. 10 is a top view of the lug adapter and lug ring of FIGS. 1, 4, and 6 shown interlocked together.

Referring now to FIGS. 8-10, lug adapter 330 is coupled to lug ring 310 by axially aligning lug adapter 330 and lug ring 310 with lower end 332*b* proximal upper end 312*a*, circumferentially aligning each group 340 of lugs 341 on lug adapter 330 with one of the segments of smooth inner surface 317 of lug ring 310, and circumferentially aligning each group 320 of lugs 321 on lug ring 310 with one segment of smooth outer surface 337 of lug adapter 330. When so aligned, lower end 332*b* of lug adapter 330 is inserted into bore 315 of lug ring 310 at upper end 312*a*, and lug adapter 330 is axially advanced into bore 315 of lug ring 310 until upper end 332*a* is axially positioned proximal upper end 312*a*, each lug 321 is circumferentially aligned with a mating slot 342, and each lug 341 is circumferentially aligned with a mating slot 342. Subsequently, lug adapter 330 is rotated in a first direction 338 about central axes 311, 331 relative to lug ring 310 until each lug 341 sufficiently engages a mating slot 322 and each lug 321 sufficiently engages a mating slot 342. Rotation of lug adapter 330 relative to lug ring 310 in the first direction 338 ceases when the lowermost lugs 341 on lug adapter 330 circumferentially abut pins 318 of lug ring 310. In this configuration, lugs 321 of lug ring 310 and lugs 341 of lug adapter 330 are intermeshed and substantially interlocked, thereby coupling lug ring 310 and lug adapter 330. Rotation of lug adapter 330 relative to lug ring 310 in the first direction 338 ceases when the lowermost lugs 341 on lug adapter 330 circumferentially abut pins 318 of lug ring 310. In this configuration, lugs 321 of lug ring 310 and lugs 341 of lug adapter 330 are intermeshed and substantially interlocked, thereby coupling lug ring 310 and lug adapter 330.

As previously described, during assembly of valve cover assembly 300, each group 340 of lugs 341 on lug adapter 330 is circumferentially aligned with one of the segments of smooth inner surface 317 of lug ring 310, and each group 320 of lugs 321 on lug ring 310 is circumferentially aligned with one segment of smooth outer surface 337 of lug adapter 330. Then, lug adapter 330 is axially inserted into bore 315 of lug ring 310, and lug adapter 330 is rotated in a first direction 338 about central axes 311, 331 relative to lug ring 310 until each lug 341 sufficiently engages a mating slot 322 and each lug 321 sufficiently engages a mating slot 342. Accordingly, lug adapter 330 may be described as having (a) a first or run-locked position relative to lug ring 310 in which lug adapter 330 may be axially moved within bore 315 of lug ring 310 (i.e., when each group 340 of lugs 341 on lug adapter 330 is circumferentially aligned with one of the segments of smooth inner surface 317 of lug ring 310, and each group 320 of lugs 321 on lug ring 310 is circumferentially aligned with one segment of smooth outer surface 337 of lug adapter 330); and (b) a second or locked position relative to lug ring 310 in which lug adapter 330 may not be axially moved within bore 315 of lug ring 310 (i.e., when each lug 341 sufficiently engages a mating slot 322 and each lug 321 sufficiently engages a mating slot 342).

As best shown in FIG. 10, when lug ring 310 and lug adapter 330 are interlocked as described above, a space or void 360 is formed radially between opposed smooth surfaces 317, 337 of lug ring 310 and lug adapter 330, respectively. Each void 360 is circumferentially bounded by interlocked lugs 321, 341. To restrict and/or prevent relative rotation of lug adapter 330 about axes 311, 331 relative to lug ring 310 (e.g., to prevent rotation in a direction opposite the first direction 338), stop locator 350 is inserted into any one of voids 360.

Figure 11:
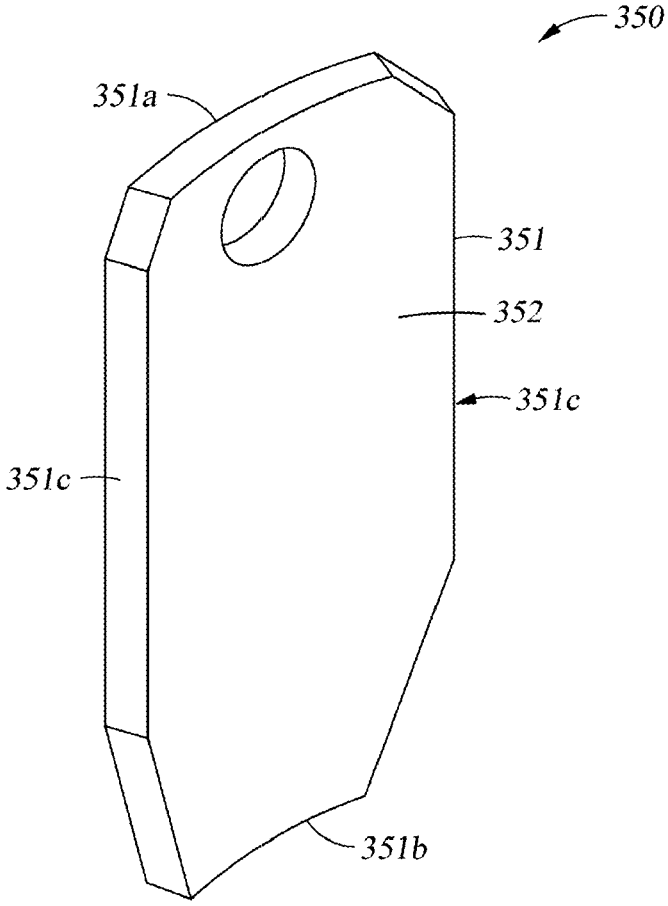
FIG. 11 is a perspective view of the stop locator of FIGS. 2 and 3.
Figure 12:
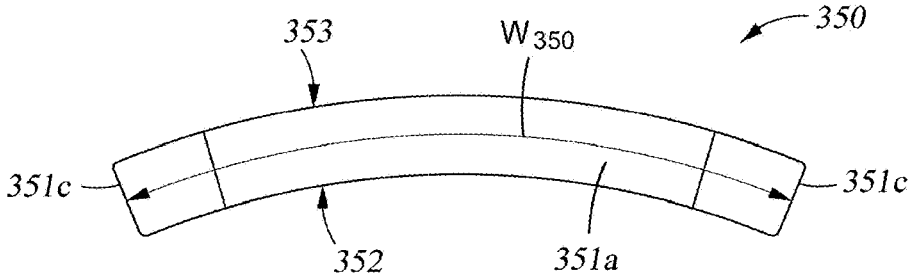
FIG. 12 is a top view of the stop locator of FIGS. 2 and 3.

Referring now to FIGS. 10, 11, and 12, stop locator 350 comprises a generally rectangular shaped body 351 having an upper end 351*a*, a lower end 351*b*, and a pair of lateral sides 351*c* extending between ends 351*a, b*. In addition, stop locator 350 has a curved inner surface 352 and a curved outer surface 353 that is substantially parallel to the curved inner surface 352. The radius of curvature of inner surface 352 is slightly greater than second outer radius $R_{330o\text{-}2}$ of outer surface 334 of lug adapter 330, and the radius of curvature of outer surface 353 is slightly less than the second inner radius $R_{310i\text{-}2}$ of inner surface 313 of lug ring 310. Stop locator 350 has a width $W_{350}$ measured circumferentially between lateral sides 351*c*. Width $W_{350}$ is less than the circumferential length of each smooth surface 317, 337 of lug ring 310 and lug adapter 330, respectively. Thus, stop locator 350 is sized and configured for insertion into one of voids 360 (FIG. 10). As previously discussed, when lug adapter 330 is interlocked within lug ring 310 and stop locator 350 is inserted into one of voids 360, as shown in FIG. 10, lug ring 310 and lug adapter 330 are restricted and/or prevented from rotating relative to each other about axes 311, 331 (in either first direction 338 or second direction 339), thereby restricting and/or preventing interlocking lugs 321, 341 from disengaging.

Figure 13:
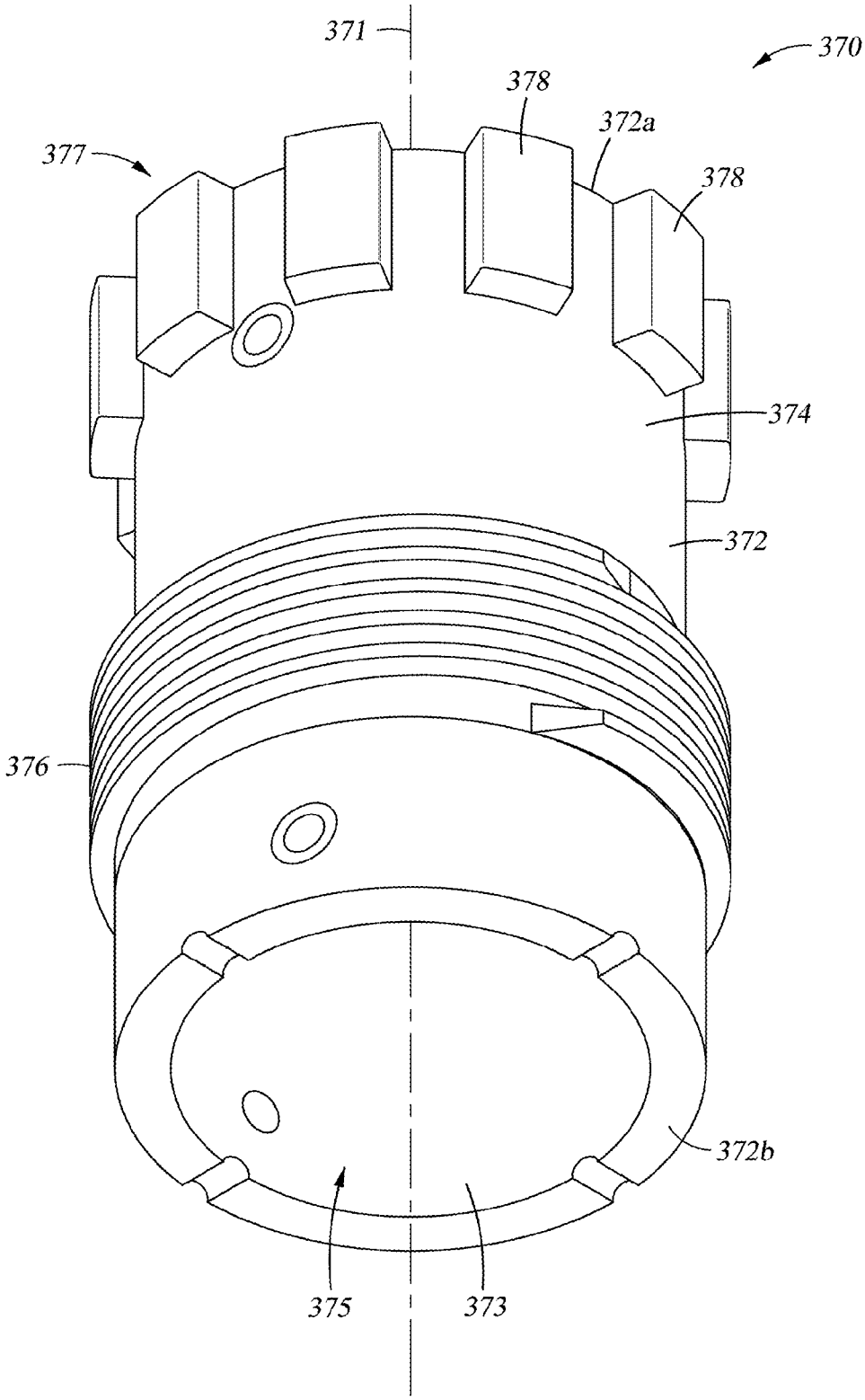
FIG. 13 is a perspective view of the locking ring of FIGS. 2 and 3.
Figure 14:
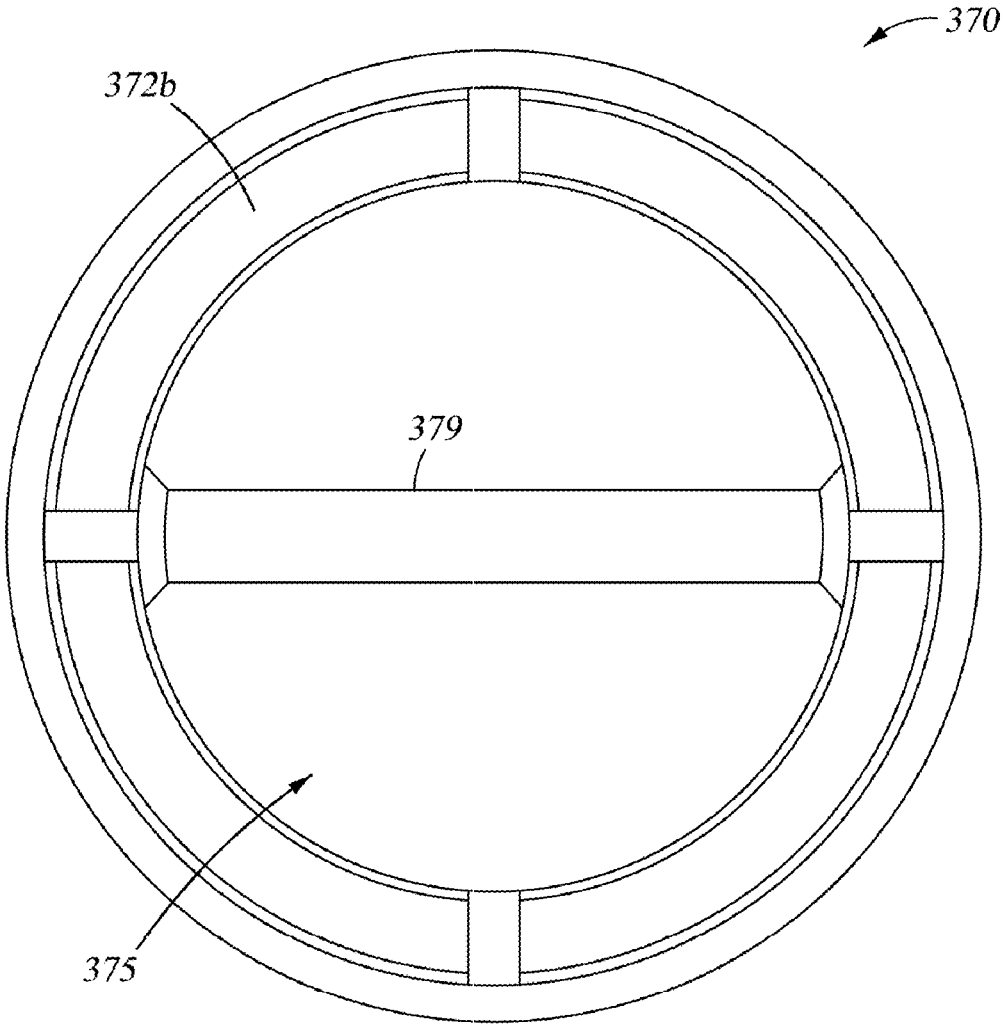
FIG. 14 is a bottom view of the lock ring of FIGS. 2 and 3.

Referring next to FIGS. 13 and 14, locking member 370 has a central axis 371 and comprises a generally cylindrical body 372 with a first or upper end 372*a*, a second or lower end 372*b*, a radially inner surface 373, and a radially outer surface 374. Radially inner surface 373 defines a central through bore 375 that extends axially through locking member 370 between ends 372*a, b*. In this embodiment, outer surface 374 includes external threads 376 positioned between ends 372*a, b*, and a torque applying means 377 at first end 372*a*.

External threads 376 extend axially over a portion of outer surface 374, and are sized and configured to engage mating internal threads 336 disposed on inner surface 333 of lug adapter 330 during assembly of valve cover assembly 300 (FIG. 8). Torque applying means 377 enable the controlled application of torque to body 372 and rotation of body 372 relative to lug adapter 330 about axes 331, 371. In this embodiment, torque applying means 377 comprises a plurality of circumferentially spaced, axially extending lugs or teeth 378 at upper end 372*a*. Lugs 378 extend radially outward on outer surface 374 and are configured to enable controlled grasping of locking member 370 by, for example, a wrench 500 (FIGS. 2 and 3), thereby enabling the application of torque to locking member 370 for the purpose of rotating locking member 370 relative to lug adapter 330 about axes 331, 371 during coupling and decoupling of these components.

Referring still to FIGS. 13 and 14, locking member 370 further includes a lifting bar 379 that extends across bore 375 proximal upper end 372*a*. Bar 379 provides a means to axially lift locking member 370. In addition, bar 379 may also be used to provide an additional means to rotate locking member 370 relative to lug adapter 330 about axes 331, 371 during assembly and disassembly of valve cover assembly 300.

Figure 15:
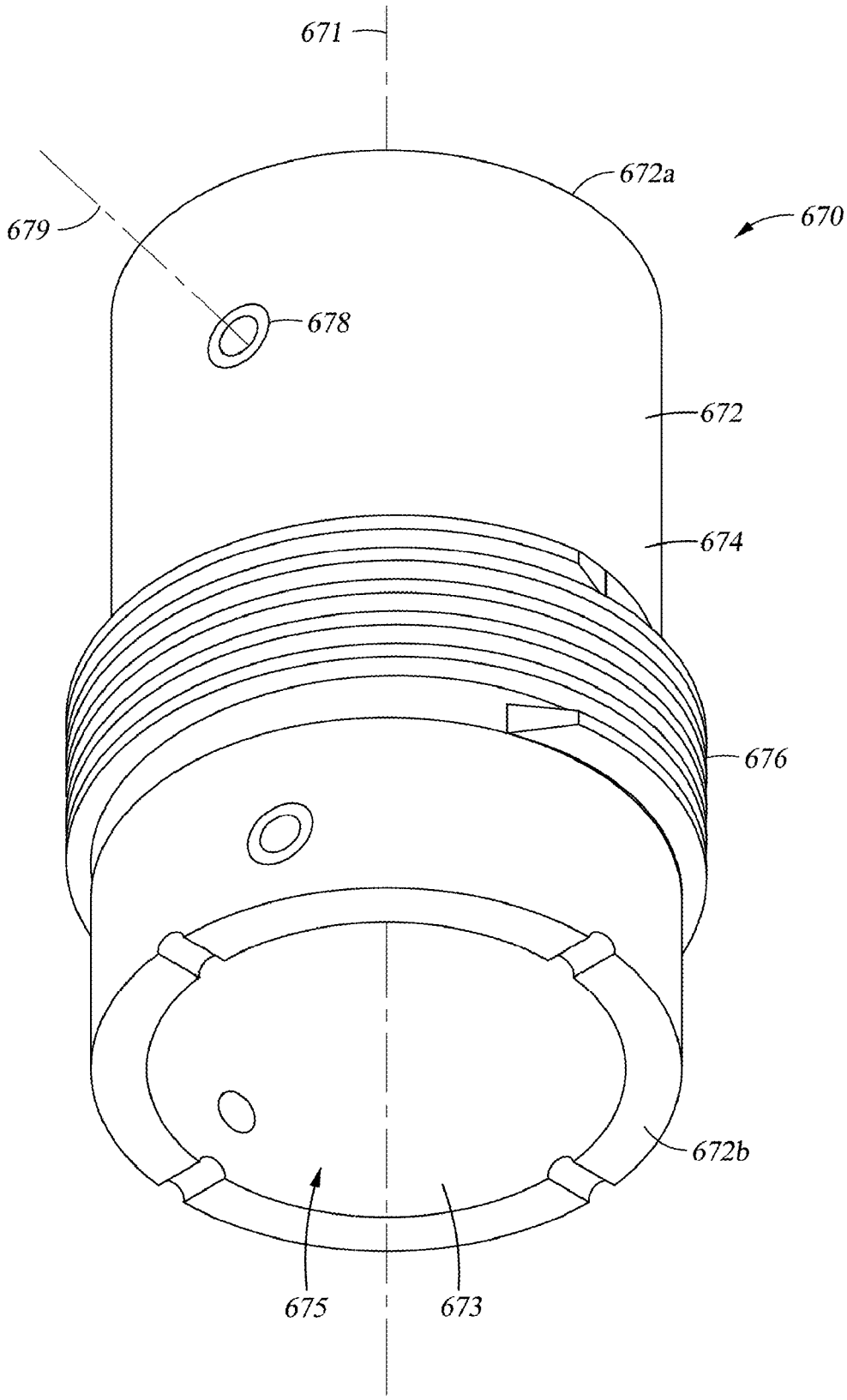
FIG. 15 is a perspective view of an alternative embodiment of a lock ring.

Referring briefly to FIG. 15, another embodiment of a lock ring 670 is illustrated. Lock ring 670 is similar to locking member 370 previously described. Namely, lock ring 670 has a central axis 671 and comprises a generally cylindrical body 672 with a first or upper end 672*a*, a second or lower end 672*b*, a radially inner surface 673, and a radially outer surface 674. Radially inner surface 673 defines a central through bore 675 extending between ends 672*a, b*. In addition, outer surface 674 includes threads 676 positioned between ends 672*a, b* and a torque applying means 677. Threads 672 extend axially over a portion of outer surface 674, and are sized and configured to engage mating internal threads 336 disposed on inner surface 333 of lug adapter 330 during assembly of valve cover assembly 300 (FIG. 8). However, in this embodiment, torque applying means 677 does not comprise teeth or lugs (e.g., lugs 378). Rather, in this embodiment, torque applying means 677 comprises a pair of holes 678 through body 672, each hole 678 extending from outer surface 674 to inner surface 673. In this embodiment, holes 678 have aligned central axes 679 such that projections of central axes 679 are coincident with one another. Further, in this embodiment, holes 678 are angularly spaced about 180° apart relative to axis 671. During assembly and disassembly, a rod or bar is inserted through aligned holes 678, and torque is applied to body 672 by urging one end of the rod about axis 671. In response to the torque load, lock ring 670 rotates about axis 671 relative to lug adapter 330.

Referring now to FIGS. 1, 2, and 3, to install valve cover assembly 300 on suction module 100 prior to operation of pump 10, lug ring 310 is first seated on suction module 100. One stud 390 is inserted through each bore 316 in lug ring 310 and threaded into one of the mating internally threaded counterbores 113 in suction module body 110. Next, locking member 370 is coaxially disposed within bore 335 of lug adapter 330, and is axially advanced into bore 335 until external threads 376 of locking member 370 axially abut internal threads 336 of lug adapter 330. Then, locking member 370 is rotated relative to lug adapter 330 about axes 331, 371 to engage mating threads 336, 376.

Using bar 379 to lift and maneuver locking member 370 (and lug adapter 330 coupled thereto) relative to lug ring 310, locking member 370 and lug adapter 330 are coupled to lug ring 310. In particular, locking member 370 and lug adapter 330 are axially aligned with lug ring 310 with lower ends 332*b*, 372*b* positioned proximal upper end 312*a*. In addition, each group 340 of lugs 341 on lug adapter 330 is circumferentially aligned with one of the segments of smooth inner surface 317 of lug ring 310, and each group 320 of lugs 321 on lug ring 310 is circumferentially aligned with one segment of smooth outer surface 337 of lug adapter 330. Next, lower end 332*b* of lug adapter 330 is inserted into bore 315 of lug ring 310 at upper end 312*a*, and lug adapter 330 is axially advanced into bore 315 of lug ring 310 until upper end 332*a* is axially positioned proximal upper end 312*a*, each lug 321 is circumferentially aligned with a mating slot 342, and each lug 341 is circumferentially aligned with a mating slot 342. Subsequently, lug adapter 330 is rotated in first direction 338 (FIG. 10) about central axes 311, 331 relative to lug ring 310 until each lug 341 sufficiently engages a mating slot 322 and each lug 321 sufficiently engages a mating slot 342. Locking member 370 and lug adapter 330 may be rotated in first direction 338 relative to lug ring 310 via bar 379 and/or wrench 500. In some cases, wrench 500 may be required to provide the necessary torque to rotate locking member 370 and lug adapter 330 relative to lug ring 310. As previously discussed, rotation of lug adapter 330 relative to lug ring 310 in the first direction 338 ceases when the lowermost lugs 341 on lug adapter 330 circumferentially abut pins 318 of lug ring 310. In this configuration, lugs 321 of lug ring 310 and lugs 341 of lug adapter 330 are intermeshed and substantially interlocked, thereby securely coupling lug ring 310 and lug adapter 330. It should be appreciated that although pins 318 restrict continued rotation of lug adapter 330 relative to lug ring 310 in the first direction 338, locking member 370 may still be rotated relative to lug adapter 330 and lug ring 310 in the first direction 338, thereby further engaging mating threads 336, 376.

Stop locator 350 is then inserted into one void 360 (FIGS. 2 and 10) to restrict and/or prevent lug adapter 330 from rotating relative to lug ring 310 and disengaging lugs 322, 341. Once stop locator 350 is installed, wrench 500 is employed to rotate locking member 370 relative to lug adapter 330 and lug ring 310 about axes 311, 331 to torque locking member 370 down against plug 170. As the torque load is applied to locking member 370, locking member 370 rotates relative to lug adapter 330 and lug ring 210 and is urged axially downward toward plug 170 and suction module body 110 until locking member 370 is sufficiently seated against plug 170 over suction valve 130. As locking member 370 rotates in this manner, lug adapter 330 is prevented from rotating with locking member 370 due to the presence of stop locator 350 between interlocked lugs 321, 341 of lug ring 310 and lug adapter 330 and the coupling of lug ring 310 via studs 390 to suction module body 110.

In the embodiment shown in FIGS. 13 and 14, locking member 370 is rotated and torqued down by gripping teeth 378 of locking member 370 with wrench 500, and then applying a torque load to locking member 370. However, in the alternative embodiment shown n FIG. 15, lock ring 670 is rotated and torqued down via a rod or bar positioned through holes 678.

Referring still to FIGS. 1, 2, and 3, in the event that suction valve 130 requires maintenance during operation of pump 10, pump operation is interrupted. Pressurized fluid within conduits 150, 250 is bled off through discharge valve 230 to allow valve cover assembly 300 to be safely removed. A torque load is applied to locking member 370 using either wrench 500 (or a bar inserted through holes 678 of the embodiment of lock ring 670 shown in FIG. 15), as described above, to unseat locking member 370 from plug 170. Next, stop locator 350 is removed from void 360, thereby allowing for the rotation of lug adapter 330 relative to lug ring 310. Then, locking member 370, with lug adapter 330 coupled thereto, is then rotated using bar 379 in second direction 339 (i.e., opposite to first direction 338) relative to lug ring 310 to fully disengage lugs 341 of lug adapter 330 from lugs 321 of lug ring 310, circumferentially align each group 340 of lugs 341 on lug adapter 330 with one of the segments of smooth inner surface 317 of lug ring 310, and circumferentially align each group 320 of lugs 321 on lug ring 310 with one segment of smooth outer surface 337 of lug adapter 330. When lugs 321, 341 are fully disengaged, locking member 370 with lug adapter 330 coupled thereto is lifted via bar 379 from lug ring 310 to expose plug 170. Plug 170 may then be removed to allow access to suction valve 130, either for servicing or replacement. Once the maintenance procedure is complete, plug 170 may be replaced and valve cover assembly 300 reinstalled as previously described.

While preferred embodiments of this invention have been shown and described, modifications thereof can be made by one skilled in the art without departing from the scope or teaching herein. The embodiments described herein are exemplary only and are not limiting. Many variations and modifications of the system, apparatus and methods are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims.

What is claimed is:

1. A method for coupling a valve cover to a pump assembly, the method comprising:

securing a first cylindrical member to the pump assembly, wherein the first cylindrical member has a central axis and an axially extending throughbore;

circumferentially aligning a set of interlocking lugs on a radially outer surface of a second cylindrical member between two adjacent sets of interlocking lugs on a radially inner surface of the first cylindrical member;

axially inserting the second cylindrical member into the throughbore of the first cylindrical member;

rotating the second cylindrical member about the central axis relative to the first cylindrical member to engage the set of interlocking lugs on the second cylindrical member with one of the sets of interlocking lugs on the first cylindrical member after inserting the second cylindrical member into the throughbore of the first cylindrical member;

axially inserting a stop locator into a void formed radially between the first and the second cylindrical members and circumferentially between the two adjacent sets of interlocking lugs on the radially inner surface of the first cylindrical member after engaging the set of interlocking lugs on the second cylindrical member with one of the sets of interlocking lugs on the first cylindrical member.

2. The method of claim 1, wherein each interlocking lug has a longitudinal axis disposed in a plane oriented perpendicular to the central axis of the first cylindrical member.

3. The method of claim 1, further comprising:

restricting the second cylindrical member from rotating relative to the first cylindrical member with the stop locator.

4. The method of claim 3, further comprising threading a third cylindrical member into an axially extending through bore in the second cylindrical member.

5. The method of claim 4, further comprising applying a torque load to the third cylindrical member;

rotating the third cylindrical member relative to the first cylindrical member and the second cylindrical member; and axially advancing the third cylindrical member into engagement with the pump assembly.

6. A valve cover assembly for a pump comprising:

a first cylindrical member having a central axis and a first throughbore, wherein the first cylindrical member has an inner surface comprising a first plurality of axially spaced lugs, wherein one slot is formed between each pair of axially adjacent lugs on the inner surface of the first cylindrical member; and a second cylindrical member coaxially disposed within the first throughbore, wherein the second cylindrical member has an outer surface comprising a first plurality of axially spaced lugs, wherein one slot is formed between each pair of axially adjacent lugs on the outer surface of the second cylindrical member;

wherein the first plurality of lugs of the first cylindrical member mate and slidingly engage the slots of the second cylindrical member, and wherein the first plurality of lugs of the second cylindrical member mate and slidingly engage the slots of the first cylindrical member;

a space radially positioned between the first cylindrical member and the second cylindrical member and circumferentially positioned adjacent the first plurality of lugs of the first cylindrical member and the first plurality of lugs of the second cylindrical member;

a stop locator wholly radially disposed within the space and configured to restrict the rotation of the second cylindrical member relative to the first cylindrical member.

7. The valve cover assembly of claim 6, wherein the inner surface of the first cylindrical member comprises at least one pin extending radially inward from one of the slots of the first cylindrical member.

8. The valve cover assembly of claim 6, wherein each lug has a longitudinal axis disposed in a plane oriented perpendicular to the central axis of the first cylindrical member.

9. The valve cover assembly of claim 6, wherein the stop locator is configured to be axially advanced into and out of the space radially disposed between the first cylindrical member and the second cylindrical member.

10. The valve cover assembly of claim 9, wherein the inner surface of the first cylindrical member comprises a second plurality of axially spaced lugs circumferentially spaced from the first plurality of lugs of the first cylindrical member;

wherein the stop locator is circumferentially disposed between the first plurality of lugs of the first cylindrical member and the second plurality of lugs of the first cylindrical member.

11. The valve cover assembly of claim 6, further comprising a third cylindrical member coupled to the first cylindrical member and the second cylindrical member;

wherein the second cylindrical member includes an axially extending throughbore and the third cylindrical member is coaxially disposed in the throughbore of the second cylindrical member.

12. The valve cover assembly of claim 11, wherein the third cylindrical member threadingly engages the second cylindrical member.

13. The valve cover assembly of claim 12, wherein the third cylindrical member has a first portion extending from the first cylindrical member and a second portion coaxially disposed within the first cylindrical member;

wherein the first portion of the third cylindrical member includes a means for applying torque to the third cylindrical member.

14. The valve cover assembly of claim 13, wherein the means for applying torque comprises a plurality of lugs extending from a radially outer surface of the third cylindrical member.

15. A pump assembly comprising:

a valve module including:

a valve module body having an inner chamber;

a valve access bore extending from an outer surface of the valve module body to the inner chamber;

a valve at least partially disposed within the inner chamber and accessible through the valve access bore;

a valve cover assembly coupled to the valve module body over the valve access opening, the valve cover comprising:

a first cylindrical member having a central axis and an axially extending throughbore, wherein the first cylindrical member has a radially inner surface comprising a plurality of circumferentially spaced groups of interlocking lugs, wherein each group of the first cylindrical member includes a plurality of axially spaced lugs;

a second cylindrical member coaxially disposed within the throughbore, wherein the second cylindrical member has a radially outer surface comprising a plurality of circumferentially spaced groups of interlocking lugs, wherein each group of the second cylindrical member includes a plurality of axially spaced lugs;

wherein each lug of the first cylindrical member is axially positioned between two of the lugs of the second cylindrical member;

a stop locator circumferentially disposed between two groups of lugs of the first cylindrical member and two groups of lugs of the second cylindrical member, wherein the stop locator has a radially inner surface relative to the central axis that is disposed radially outward of the outer surface of the second cylindrical member and a radially outer surface relative to the central axis that is disposed radially inward of the inner surface of the first cylindrical member; and a third cylindrical member rotatably coupled to the second cylindrical member.

16. The pump assembly of claim 15, wherein the interlocking lugs of the first cylindrical member are interlocked with the interlocking lugs of the second cylindrical member.

17. The pump assembly of claim 15, further comprising:

a plurality of voids radially positioned between the first cylindrical member and the second cylindrical member, wherein each void is circumferentially disposed between two of the groups of interlocking lugs of the first cylindrical member; and wherein the stop locator is disposed in one of the voids and is configured to restricts the rotation of the second cylindrical member relative to the first cylindrical member.

18. The pump assembly of claim 15, further comprising a piston-cylinder assembly coupled to the valve module body;

wherein the piston-cylinder assembly includes a cylinder, a piston coaxially disposed in the cylinder, and a fluid chamber defined by the cylinder and piston, the fluid chamber in fluid communication with the inner chamber of the valve module body.

19. The pump assembly of claim 15, wherein each interlocking lug has a longitudinal axis disposed in a plane oriented perpendicular to the central axis of the first cylindrical member.

20. The pump assembly of claim 15, wherein the second cylindrical member has a central axis, an axially extending throughbore, and a radially inner surface defining the throughbore;

wherein the third cylindrical member is coaxially disposed in the throughbore of the second cylindrical member;

wherein the third cylindrical member is coupled to the second cylindrical member by mating threads disposed on a radially inner surface of the second cylindrical member and a radially outer surface of the third cylindrical member.

21. The pump assembly of claim 20, wherein the third cylindrical member has a first end distal the valve module body and a second end proximal the valve module body, and wherein the third cylindrical member comprises a means for applying torque to the third cylindrical member proximal the first end.

22. The pump assembly of claim 21, wherein the means for applying torque to the third cylindrical member comprises a plurality of axially extending lugs on the radially outer surface of the third cylindrical member.

23. The pump assembly of claim 21, wherein the means for applying torque to the third cylindrical member comprises two holes extending from the radially outer surface of the third cylindrical member to a radially inner surface of the third cylindrical member;

wherein each hole has a central axis;

wherein the central axes of the two holes are aligned and adapted to receive an elongate rod.

24. The pump assembly of claim 21 further comprising a plug seated in the valve access bore;

wherein the second end of the third cylindrical member engages the plug and restricts disengagement of the plug and the valve access bore.

* * * * *